US005486443A

United States Patent [19]

Grande et al.

[11] Patent Number: 5,486,443

[45] Date of Patent: Jan. 23, 1996

[54] MAGNETIC TONER COMPOSITIONS WITH SILICA, STRONTIUM TITANATE AND POLYVINYLIDENE FLUORIDE

[75] Inventors: Michael L. Grande, Palmyra; Bernard Grushkin, Pittsford; Eugene F. Young, Rochester; Douglas A. Lundy; Joseph R. E. Matalevich, both of Webster, all of N.Y.

[73] Assignee: Xerox Corporation, Stamford, Conn.

[21] Appl. No.: 331,444

[22] Filed: Oct. 31, 1994

[51] Int. Cl.[6] ..... G03G 9/09; G03G 9/083; G03G 9/097

[52] U.S. Cl. ..... 430/106; 430/106.6; 430/110

[58] Field of Search ..... 430/106, 106.6, 430/110

[56] References Cited

U.S. PATENT DOCUMENTS

| | | | |
|---|---|---|---|
| Re. 33,172 | 2/1990 | Gruber et al. | 430/39 |
| 3,590,000 | 6/1971 | Palermiti et al. . | |
| 3,900,588 | 8/1975 | Fisher . | |
| 3,983,045 | 9/1976 | Jugle et al. . | |
| 4,517,268 | 5/1985 | Gruber et al. | 430/39 |
| 4,626,487 | 12/1986 | Mitsuhashi et al. | 430/110 X |
| 4,758,493 | 7/1988 | Young et al. | 430/122 |
| 4,789,613 | 12/1988 | Ohtani et al. | 430/110 |
| 4,859,550 | 8/1989 | Gruber et al. | 430/39 |
| 4,966,829 | 10/1990 | Yasuda et al. | 430/109 |
| 5,158,851 | 10/1992 | Fuller et al. | 430/106 |
| 5,166,026 | 11/1992 | Fuller et al. | 430/106 |
| 5,219,695 | 6/1993 | Tanikawa | 430/106.6 |
| 5,219,697 | 6/1993 | Mori et al. | 430/110 |
| 5,278,018 | 1/1994 | Young et al. | 430/110 |

*Primary Examiner*—Roland Martin
*Attorney, Agent, or Firm*—Eugene O. Palazzo

[57] ABSTRACT

A toner comprised of resin particles, magnetite, carbon black, rhodamine charge additive, wax, and a surface mixture of silica, strontium titanate and polyvinylidene fluoride.

53 Claims, No Drawings

MAGNETIC TONER COMPOSITIONS WITH SILICA, STRONTIUM TITANATE AND POLYVINYLIDENE FLUORIDE

BACKGROUND OF THE INVENTION

The invention is generally directed to toner and developer compositions, and more specifically, the present invention is directed to developer and toner compositions containing charge enhancing additives which impart or assist in imparting a positive charge to the toner resin particles and enable toners with rapid admix characteristics, and wherein there is selected as the primary toner pigment a magnetite, especially an acicular magnetite and which magnetite is available from Magnox, Inc., Wilmington, Del., and wherein the toner contains certain toner additives. In embodiments of the present invention, there are provided toners comprised of resin particles, magnetite particles, pigment particles of carbon black, charge enhancing additives comprised of the salts of RHODAMINE 6G™ such as the silico molybdate salt of RHODAMINE 6G™ available as FANAL PINK 4830™ from BASF Corporation, Clifton, N.J., pigments such as carbon black, wax, and surface additives of silica, especially fumed silicas available from Wacker Chemicals, or alumina; strontium titanate; and a polyvinylidene fluoride such as KYNAR®. The toner compositions of the present invention in embodiments thereof possess excellent admix characteristics, maintain their triboelectric charging characteristics for an extended number of imaging cycles, and enable the elimination or minimization of undesirable comets on the imaging member or photoconductor. Furthermore, the toner compositions of the present invention are substantially insensitive to relative humidity in a machine environment and permit developed images with excellent optical densities and low background. Developers of the present invention are comprised of the aforementioned toners and carrier particles, especially carrier particles comprised of a core with a mixture of polymers thereover. The toner and developer compositions of the present invention can be selected for electrophotographic, especially xerographic, imaging and printing processes and preferably magnetic image character recognition processes (MICR) such as processes similar to those selected for the Xerox Corporation 8790/9790 MICR machines, and preferably the Xerox Corporation 4135® MICR test fixture or machine, and wherein personal checks with no, or minimal comets can be generated.

Toner and developer compositions with wax and certain surface additives, such as silicas, KYNAR®, or metal oxides are known. Illustrated, for example, in U.S. Pat. 3,900,588 is a toner with surface additive mixtures of silica or strontium titanate and polymers like KYNAR®, see column 7, lines 12 to 17. This patent discloses, for example, a toner with a minor amount of a polymeric additive like KYNAR®, and a minor amount of an abrasive material, such as silica, like AEROSIL R972®. Toners and developers with surface additives of metal salts of fatty acids like zinc stearate and silica are known, reference for example U.S. Pat. Nos. 3,983,045 and 3,590,000. In U.S. Pat. 4,789,613, there is illustrated a toner with an effective amount of, for example, strontium titanate dispersed therein, such as from about 0.3 to about 50 weight percent. Also disclosed in the '613 patent is the importance of the dielectric material with a certain dielectric constant, such as strontium titanate, being dispersed in the toner and wherein the surface is free or substantially free of such materials. Further, this patent discloses the use of known charge controllers in the toner, see column 4, line 55, olefin polymer, see column 5, line 35, and a coloring agent like carbon black as a pigment. Treated silica powders for toners are illustrated in U.S. Pat. 5,306,588. Toners with waxes like polypropylene and polyethylene are, for example, illustrated in U.S. Pat. Nos. 5,292,609; 5,244,765; 4,997,739; 5,004,666 and 4,921,771, the disclosures of which are totally incorporated herein by reference. Magnetic toners with low molecular weight waxes and external additives of a first flow aid like silica and metal oxide particles are illustrated in U.S. Pat. 4,758,493, the disclosure of which is totally incorporated herein by reference. Examples of metal oxide surface additives are illustrated in column 5, at line 63, and include strontium titanate. Single component magnetic toners with silane treated magnetites are illustrated in U.S. Pat. 5,278,018, the disclosure of which is totally incorporated herein by reference. In column 8 of the '018 patent, there is disclosed the addition of waxes to the toner and it is indicated that surface additives such as AEROSIL®, metal salts of fatty acids and the like can be selected for the toner. Magnetic image character recognition processes and toners with magnetites like MAPICO BLACK® are known, reference for example U.S. Pat. No. Re. 33,172, the disclosure of which is totally incorporated herein by reference, and U.S. Pat. No. 4,859,550. The 33,172 patent also discloses certain toners with AEROSIL® surface additives. The toners and developers of the present invention may in embodiments be selected for the MICR and xerographic imaging and printing processes as illustrated in the 33,172 patent.

Moreover, toners with charge additives are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchlorate, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, TRH as a charge additive is illustrated in a number of patents, such as U.S. Pat. No. 5,278,018, the disclosure of which is totally incorporated herein by reference.

Toners with FANAL PINK® charge additives appear to be illustrated in U.S. Pat. Nos. 5,158,851 and 5,166,026, the disclosures of which are totally incorporated herein by reference. These patents appear to disclose FANAL PINK®, a rhodamine salt, as charge control agent for toners with a multiblock binder resin ('851 patent) and for semicrystalline olefin binder resin based toners ('026 patent). Also, U.S. Pat. No. 4,268,599 appears to indicate the use of RHODAMINE B® as a component for coating carrier to control charge to mass ratio on the carrier. BASF European publication EP 392356-B1 (90-314079/42) illustrates xanthene dyes such as RHODAMINE® in electrophotographic toners.

The disclosures of each of the patents mentioned herein are totally incorporated herein by reference.

Disclosed in copending patent application U.S. Ser. No. 299,875 the disclosure of which is totally incorporated herein by reference, is a single component toner comprised of resin particles, magnetite treated, or coated with a phosphate titanium component wax, and surface additives comprised of mixtures of silicas and strontium titanate.

SUMMARY OF THE INVENTION

Examples of objects of the present invention include the following.

It is an object of the present invention to provide toner and developer compositions with many of the advantages illustrated herein.

In another object of the present invention there are provided toner compositions with wax,and certain charge additives, and a surface additive mixture comprised, for example, of silica, polyvinylfluoride, and strontium titanate, and which toners are substantially insensitive to relative humidity, possess excellent admix characteristics, stable $A_t$ properties, no evidence of comets when the toner is selected for the development of images after 1.4 million imaging cycles, or when the toner is tested in an aging fixture for 140 hours, and which toners are useful for the development of electrostatic latent images, or which toners can preferably be selected for MICR methods, and wherein personal checks with no or minimal comets are generated.

In yet another object of the present invention there are provided positive charged toner compositions with excellent admix, such as less than 15 seconds, and more specifically from greater than zero to about 15 seconds, and excellent stable triboelectric characteristics.

In yet a further object of the present invention there are provided positively charged toners which admix in less than 15 seconds, that is, new toner added to developer in a Xerox Corporation MICR development apparatus, such as the Xerox Corporation 4135® test printer, will rapidly attain, within 15 seconds or less, the charge and charge distribution of the added new toner and with none or minimal increase in wrong sign, that is negatively charged toner.

It is a further object of the present invention to provide toner and developer compositions which, when used in a developing apparatus such as the Xerox Corporation 4135® MICR test printer, will exhibit excellent toner and developer flow characteristics.

Also, it is a further object of the present invention to provide toner compositions that will not exhibit abrasive properties when used in printing apparatus, such as MICR printers, that incorporate an electrostatic brush cleaner.

Moreover, in another object of the present invention there are provided toners that reduce or minimize the wearing of machine components, such as detone blades, which components possess increased lifetimes.

In yet a further object of the present invention there are provided humidity insensitivity toners of, from about, for example, 10 to 90 percent relative humidity at temperatures of from 60° to 80° F. as determined by operating a Xerox Corporation 4135® test fixture printer apparatus in a relative humidity testing chamber and toners that enable developed electrostatic images with excellent lines and solids that do not exhibit, or have minimal smudge or background.

Another object of the present invention resides in the provision of toners that can enable developed electrostatic images with excellent optical densities of, for example, at least about 1.2 and, more specifically, from about 1.2 to about 1.4, and which toners will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 60 copies per minute, and more specifically, MICR printing processes with speeds of 135 prints per minute, and wherein no comets or the number of comets formed on the photoreceptor is minimal and do not appear on the printed document.

It is yet another object of the present invention to provide toner compositions, especially with styrene butadiene, or polyester resins, which, when a fused toner image is brought into contact with vinyl plastics that have been plasticized to impart flexibility, do not exhibit vinyl offset, that is transfer of the image to the vinyl at moderate temperature and pressure.

It is yet another object of the present invention to provide toner compositions wherein fused images generated therefrom are suitable for nonimpact MICR (magnetic image character recognition) applications wherein documents, such as checks with a xerographically printed MICR line, can be magnetically read and sorted with reliability in apparatus, such as the IBM 3890® reader/sorter, that is, after multiple passes through an IBM 3890® a minimal number of checks, less than 0.2 percent, are rejected because of smears or voids on the MICR line.

Another important object of the present invention is to provide toners that enable developed images with no comets that, for example, obscure the image or character, and deposit on the photoreceptor or the substrate such as paper.

Further, in another important object of the present invention there are provided toners with a narrow $A_t$ of, for example, from about 65 to about 85 for extended print runs, such as for over 2,000,000 copies.

Additionally, in another important object of the present invention there are provided toners that are substantially humidity insensitive for an extended number of copies in a MICR process.

Another important object of the present invention is the provision of toners, especially MICR toners, with the combination of excellent characteristics of rapid admix, superior flow, excellent optical density, humidity insensitivity, desired narrow $A_t$, charging of the imaging member at lower voltages, such as 500 to 600 volts, instead of 800 volts thereby increasing the life of the member, decreased or minimal wear on machine components, such as toner detone blades, and a high positive triboelectric toner charge.

Moreover, another object of tie present invention resides in the provision of toners with a surface additive mixture of three components, a first additive that improves developer admix and xerographic performance; a second additive that functions primarily as an abrasive and prevents or minimizes the formation of comets on a layered photoreceptor, or photoconductor; and a third additive which functions primarily as a lubricant, prevents or minimizes comet formation, prevents excessive wear of the cleaner subsystem detone blade, and permits stable $A_t$.

In embodiments, the toners of the present invention are comprised of certain resin particles, magnetite particles, waxes, and charge enhancing additives, and which toners contain surface additives comprised of a mixture of, for example, silica, especially fumed silicas, such as the AEROSILS® available from Degussa Chemicals, polyvinylidene fluoride, and metal oxides or salts thereof, especially strontium titanate. More specifically, the present invention is directed to toner compositions, or particles comprised of resins, such as styrene methacrylates, styrene acrylates, styrene butadienes, polyesters, and the like, and preferably styrene butadienes, low molecular weight waxes, for example from about 500 to about 20,000 $M_w$ and preferably from about 1,000 to about 7,000 $M_w$ (weight average molecular weight), magnetites, especially acicular magnetites, carbon black pigments like REGAL 330®, the positive charge additive FANAL PINK™, an insoluble salt of RHODAMINE 6G™ available from BASF, and a surface additive mixture comprised of silica, preferably fumed silica, strontium titanate, and polyvinylidene fluoride, or KYNAR®.

In embodiments, the toners of the present invention are comprised of resin particles, magnetite particles, pigments of carbon black, waxes, and charge enhancing additives, and which toners contain surface additives comprised of a mixture of alumina, that is aluminum oxide, especially Alumina C-604, or Alumina C available from Degussa Chemicals, polyvinylidene fluoride, and metal oxides or salts thereof, especially strontium titanate. More specifically, the present invention is directed to toner compositions, or particles comprised of resins, such as styrene methacrylates, styrene acrylates, styrene butadienes, polyesters, and the like, and preferably styrene butadienes, low molecular weight waxes, for example from about 500 to about 20,000 $M_w$ and preferably from about 1,000 to about 7,000 $M_w$ (weight average molecular weight), magnetites, especially acicular magnetites, carbon black pigments like REGAL 330®, the positive charge additive FANAL PINK®, an insoluble salt of RHODAMINE 6G™ available from BASF, and a surface additive mixture comprised of aluminum oxide, strontium titanate, and polyvinylidene fluoride, or KYNAR®. With the three component additive mixture containing aluminum oxide, there is enabled, for example, broader toner concentrations, for example 3 to 5, while providing other advantages as indicated herein, than when silica is a component in the mixture. Toners with the aluminum oxide surface additive mixture are recited in 331,441 filed concurrently herewith, entitled MAGNETIC TONER COMPOSITIONS WITH ALUMINUM OXIDE, the disclosure of which is totally incorporated herein by reference.

Examples of resin particles present in various effective important amounts, such as from about 50 to about 75 and preferably from about 60 to about 70 and more preferably about 62 weight percent, include styrene butadiene copolymers, such as PLIOTONE®, and wherein the styrene is present, for example, in an amount from about 60 to about 95 weight percent and the butadiene is present in an amount of from about 5 to about 30 weight percent, and wherein the preferred ranges are from 80 to 90 weight percent styrene and 10 to 20 weight percent butadiene. These resins and certain polyesters provide toners that exhibit, for example, no, or minimal toner developed vinyl offset. Resin examples include copolymers of styrene and isoprene wherein the isoprene is present in an amount of from 10 weight percent to 16 weight percent; styrene copolymerized with one, two or more of the monomers methyl methacrylate, ethyl methacrylate, butyl methacrylate, isobutyl methacrylate hexyl methacrylate, 2-ethyl hexyl methacrylate, or mixtures thereof; certain toner resins polyamides and certain toner resin polyimides.

Numerous well known suitable pigments can be selected primarily for enhancing the black color of the magnetites present. These pigments include carbon blacks, such as REGAL 330® and the like available from Cabot Corporation and Columbian Chemicals. The carbon black pigment is present in a sufficient effective amount, such as from about 1 percent by weight to about 5 percent by weight, and preferably from about 1 to about 3 weight percent based on the total weight of the toner components. In embodiments, it is important that the carbon black like REGAL 330® be present in an amount of about 3 weight percent.

Magnetites selected, preferably octahedral, spheroidal or acicular magnetites, include a mixture of iron oxides ($FeO.Fe_2O_3$) including those commercially available such as ISK MO-4232, and which magnetites are present in the toner composition in an amount of from about 25 percent by weight to about 40 percent by weight, and preferably in an amount of from about 27 percent by weight to about 32 percent by weight so as to impart a magnetic retentivity of from 7 to 13 emu/gram of toner and preferably from 8.5 to 11 emu/gram of toner when measured at a 1,000 Oersted field strength in a vibration magnetometer such as VSM 155 or comparable device. Also, surface treated magnetites, such as those available from Toda Kogyo Inc, can be selected. These treated magnetites can contain coatings such as phosphate, titanium or silane coupling agent components in an amount, for example, of from about 0.5 to about 2 weight percent. Specific examples of untreated and treated magnetites that can be selected include Magnox Corporation MAGNOX B-350® and B-353®, ISK magnetics MO-4232®, HX-3204®, MCX-2096®, MO-7029® and MO-4431®, or Toda Kogyo Corporation MTA-740® or MTA-230®. Examples of surface treated magnetites include MO-7029® and MO-4431®. In embodiments of the present invention, the preferred magnetite is Magnox B-353® present in an amount of from about 27 to about 29 weight percent.

Waxes with a molecular weight of from about 500 to about 20,000 such as polyethylene, polypropylene, reference for example British Patent Publication 1,442,835, the disclosure of which is totally incorporated herein by reference, and paraffin waxes can be included in, or on the toner compositions in embodiments of the present invention primarily as fuser roll release agents and to avoid or minimize offset of the toner to paper. Examples of preferred waxes include crystalline polyethylene wax with a weight average molecular weight of from about 1,000 to about 3,000 like POLYWAX 1,000®, 2,000® and 3,000® as obtained from the Petrolite Corporation. Other suitable waxes can be Shamrock Chemicals Ceralube 363, Super Taber 5509, WEGO GT8520, and the like. Functionalized alcohol waxes such as Petrolite Corporation UNILIN 425®, UNILIN 550® and UNILIN 700® also can be selected, see U.S. Pat. No. 4,883,736, the disclosure of which is totally incorporated herein by reference. These waxes are present in various important effective amounts such as, for example, from about 3 to about 9 percent and preferably from about 4.5 to about 6 weight percent. One preferred wax is the highly crystalline polyethylene wax with a specific gravity of equal to or greater than 0.93 and which waxes are available from Petrolite Corporation. In embodiments waxes, such as VISCOL 550 and 660P, are not preferred since these waxes may cause image smearing.

The charge additive, which is preferably contained in the toner, is comprised of an insoluble salt of RHODAMINE 6G®, benzoic acid, 2-[6-(ethylamino)- 3-(ethylimino)-3H-xanthen-9-ethyl]ethyl ester of the following formula/structure

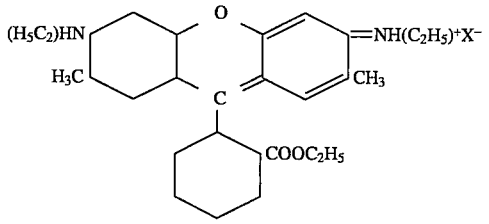

where X=silico molybdate, phosphomolybdate, phosphotungstmolybdate, or the anion of copper ferrocyanic acid.

The rhodamine salt charge additives can be obtained from BASF as FANAL PINK 4680®, 5460®, 5480® and preferably as FANAL PINK 4830®. The preferred charge additive is BASF FANAL PINK 4830®. The charge additive is present in an amount of from about 0.5 to about 5 and preferably from about 0.7 to about 1.5 weight percent. The preferred charge additive is wherein X is silico molybdate, that is FANAL PINK D 4830® obtained from BASF. Other charge additive salts that may be selected in embodiments include RHODAMINE 6G® salts derived from RHODAMINE B®, C.I. pigment Violet 1, such as ethanaminium, N-[9-(2-carboxyphenyl)-6-(diethylamino)-3H-xanthen-3-ylidene]-N-ethyl phosophomolybdate can also be selected as charge controlling agents.

Generally, the rhodamine salt charge additive selected for the toners of the present invention are represented by the following formula

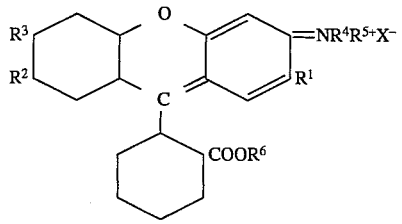

where:

$R^1$=H, or alkyl like —$CH_3$ $R^2$=H, or alkyl like —$CH_3$ $R^3$=—NH(alkyl like $C_2H_5$), or —$N(C_2H_5)_2$ $R^4$=H, or alkyl like —$C_2H_5$ $R^5$=—$C_2H_5$, —$C_6H_5$, —$C_6H_4SO_3$, —$C_6H_3$-2,6-$(CH_3)_2$ $R^6$=H, $C_2H_5$ X=silicomolybdate, phosphomolybdate, phosphotungstmolybdate, or the anion of copper ferrocyanic acid.

The R substituents may be, as appropriate, alkyl, aryl, substituted alkyl, or substituted aryl, and the like in embodiments.

The external surface additive mixture includes colloidal silicas such as AEROSIL®, or treated silicas, strontium titanate, and polyvinylidene fluoride. Each of the additives is present on the toner in important amounts, that is from about 0.5 to about 2.0 and preferably about 1 weight percent of silicas, preferably treated silicas like Wacker HDK 2050 EP; from about 0.5 to about 2.0 and preferably from about 0.5 to about 1.25 weight percent of strontium titanate such as $SrTiO_3$ Code No. 218 obtained from Ferro Corporation and with an average diameter size of 1.3 microns as measured by Coulter Counter; and from about 0.25 to about 2.0 and preferably from about 0.5 to about 1.25 weight percent of polyvinylidene fluoride, preferably KYNAR 210F® or 310F® available from Autochem.

The toners of the present invention in embodiments, which are selected for magnetic ink character recognition (MICR) processes, incorporate a high amount of wax primarily to prevent smudge and dirt formation. These toners, because of the presence of wax, can exhibit poor toner and developer powder flow properties; avoided or minimized with, for example, the addition of silica or alumina surface flow aids. Poor toner and developer flow can prevent optimum toner performance in a xerographic development apparatus. It is thus, therefore, important for the toners of the present to contain the surface additive mixture. The RHODAMINE® salt charge additive together with the other toner invention components enable toners with higher positive charge with less wrong sign toner. Therefore, for example, the use of rhodamine salts allows sufficient surface additive to improve powder flow without reducing toner charge to an unusable level.

In embodiments, the toner of the present invention preferably contains 27 to 32 percent (weight percent) of acicular magnetite; 0.7 to 1.5 percent of FANAL PINK 4830®; 4.5 to 6 percent of the crystalline polyethylene wax POLYWAX 2000® with a $M_w$ of 1,000 to 3,000; 1 to 5 weight percent of REGAL 330® carbon black; styrene butadiene copolymer resin (PLIOTONE®); and three surface additives of 1 percent (weight) Wacker HDK 2050 EP treated silica, or aluminum oxide; 0.5 to 1.25 percent of Ferro Corporation strontium titanate, No. 218; and 0.5 to 1.5 percent of Auto Chem KYNAR 210F® or KYNAR 310F®.

While not being desired to be limited by theory, the following is provided:

(1) The addition of the positively surface treated silica not only improves toner and developer powder flow properties, such as cohesivity, as measured by a Hosokawa Powders Tester, or developer flow as measured on an inclined plane apparatus, but also results in a toner exhibiting a narrow charge distribution. This silica also enables rapid admix, that is when toner is added to a developer while in a printer or copier, the newly added toner rapidly charges up to that of incumbent toner. In a high speed printing apparatus, such as the Xerox 4135® test printer, if admix time is excessively long, for example >30 seconds, as measured in a toner charge spectrograph, there is a propensity for forming background on the nonimaged area due to an excessive amount of low charge and wrong sign toner being present in the developer.

(2) Photoreceptors that use a blade to remove toner and other debris that have not transferred to paper may form spots of impacted toner on the photoreceptor which eventually will print out. Such spots, because of their shape are referred to as comets. Strontium titanate particles that have been added to the surface of the toner develop out onto the photoreceptor as individual particles not necessarily associated with toner particles. The strontium titanate particles prevent the formation of comets by continuously scrubbing the photoreceptor surface free of impacted toner. The strontium titanate, however, because it is an abrasive material, can be somewhat detrimental to other subsystems; for example, the detone roll and detone blade that are used in an electrostatic brush cleaner may exhibit wear and undergo failure.

(3) KYNAR® is added to the surface of the toner to function primarily as a lubricant to reduce any abrasive wear of the detone roll and detone blade. The KYNAR® also functions to extend the usable life for the developer. Over the course of many hours, such as 100, of use in a developing apparatus, the average charge on the toner can decrease to the point that it is no longer functional. By incorporating KYNAR® on the surface of the toner, the developer can be utilized for extended periods of time and enable documents with excellent print quality.

One preferred toner contains 61.75 weight percent of styrene butadiene polymer, 89/11 ratio of styrene to butadiene, 27 to 32 weight percent of acicular magnetite, 4.5 to 6 weight percent of the high density crystalline polyethylene wax, such as polywax 2,000 available from Petrolite Corporation, 0.7 to 1.5 weight percent of charge additive FANAL PINK 4830®, REGAL 330® carbon black in an amount 3 weight percent, and the surface additive mixture.

The toner of the present invention may be selected for use in electrostatographic imaging apparatuses containing therein conventional photoreceptors. Thus, the toner and developer compositions of the present invention can be used with layered photoreceptors, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys; amorphous silicon; layered members comprised of photogenerating components like selenium; and charge transport molecules like aryldiamines, reference U.S. Pat. No. 4,265,990, the disclosure of which is totally incorporated herein by reference. For the layered flexible imaging members photogenerating components include selenium, trigonal selenium, selenium alloys, phthalocyanines and charge transport layers of aryl amines as illustrated in U.S. Pat. No. 4,265,990.

The toner compositions prepared by known melt blending processes, or by extrusion are usually jetted and classified subsequent to preparation to enable toner particles with a preferred average volume diameter of from about 5 to about 25 microns, and more preferably from about 8 to about 13 microns.

For the formulation of developer compositions, there are mixed with the toner particles of the present invention carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron, ferrites, including copper zinc ferrites, magnetic iron oxides and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Preferred are polymer coatings not in close proximity in the triboelectric series, reference U.S. Pat. Nos. 4,937,166 and 4,935,326, the disclosures of which are totally incorporated herein by reference, including, for example, KYNAR® and polymethylmethacrylate mixtures (40/60 to 55/45). Coating weights can vary as indicated herein; generally, however, from about 0.3 to about 2, and preferably from about 0.4 to about 1.5 weight percent coating weight is selected.

Furthermore, the diameter of the carrier particles, preferably nonspherical in shape, is generally from about 50 microns to about 1.000 microns and preferably from about 75 to about 150 microns, thereby permitting them to possess sufficient density and inertia to avoid adherence to the electrostatic images during the development process. The carrier component can be mixed with the toner composition in various suitable combinations, such as for example 1 to 6 parts per toner to about 100 parts to about 200 parts by weight of carrier.

The following Examples are being supplied to further define various species of the present invention, it being noted that these Examples are intended to illustrate and not limit the scope of the present invention. Parts and percentages are by weight unless otherwise indicated. Comparative information is also provided.

EXAMPLE I

There was prepared a toner by melt blending in a Banbury apparatus and rubber mill, followed by mechanical attrition, which toner contains 61.75 percent by weight of a styrene-butadiene copolymer containing 90 percent by weight of styrene and 10 percent by weight of butadiene obtained from Goodyear Chemicals Corporation as PLIOTONE®, and 29 percent by weight of the acicular magnetite MAGNOX B-353®, the highly crystalline polyethylene wax POLY-WAX 2000® as obtained from Petrolite Corporation and of a density greater than 0.93 gram/cc in an amount of 5.25 percent by weight, 1.0 percent by weight of the charge control agent FANAL PINK 4830®, the phosphomolybdate salt of Rhodamine obtained from BASF, and 3 percent by weight of REGAL 330® carbon black obtained from Cabot Corporation. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9 to 11 microns.

Subsequently, there was added to the resulting toner particles surface by blending in a Lodige blender, 1.0 percent by weight of Wacker-Chemie GmbH HDK® H2050 EP hydrophobic positively charging silica, 0.5 percent by weight of strontium titanate, obtained from Ferro Corporation (CODE 218), and 0.5 percent by weight of polyvinylidene fluoride, KYNAR 201® obtained from Atochem, Inc. of North America.

There was prepared a developer composition by mixing the aforementioned formulated toner composition at 3.0 percent toner concentration, that is 3 parts by weight of toner per 100 parts by weight of carrier, with carrier comprised of an iron core, obtained from Hoganaes Corporation, with 0.6 weight percent of a polymeric coating mixture of KYNAR 201® and polymethylmethacrylate in ratio of 48 weight percent of KYNAR® and 52 weight percent of polymethylmethacrylate (PMMA).

Triboelectric charging of the toner in the aforementioned developer was determined by shaking in a paint mixer 100 grams of the developer in an 8 ounce jar for fifteen minutes, then measuring the charge on the toner in a Faraday Cage apparatus. The charge on the toner was determined to be a positive 23 μC/gram. To the developer was then added an additional 1.0 weight percent of toner and the developer was shaken for fifteen seconds after which the charge distribution of the toner was measured in a Xerox Corporation toner charge spectrograph apparatus. The charge spectrum exhibited a single narrow peak indicating that the added 1.0 weight percent of uncharged toner had admixed with the incumbent toner in 15 seconds or less. The toner average charge distribution (Q/D) was 0.60 fC/micron, wherein Q is the charge on the toner particles or particle, and D is the diameter of the particle or particles. The width of the distribution as determined by the standard deviation of Q/D divided by Q/D was 0.689.

The aforementioned developer composition was utilized to develop latent images generated in a Xerox Corporation MICR 4135® test printer apparatus, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)- 1,1'-biphenyl-4,4'-diamine dispersed in MAKROLON®, a polycarbonate resin obtained from Larbensabricken Bayer A.G., prepared as disclosed in U.S. Pat. No. 4,265,990, the disclosure of which is totally incorporated herein by reference, to a paper substrate and the images were fused to paper for 1.4 million copies, each with from 4 to 30 percent area coverage. Furthermore, this test was conducted under temperature and humidity conditions of 60° F. to 80° F. and 20 to 80 percent relative humidity. The developer charging properties remained essentially constant throughout the test, that is for 1.4 million copies, as determined by periodic measurements of toner triboelectric charge and toner concentration in the developer. The values of, for example, $A_t$ remained constant, about 92, throughout this test as determined from the following calculation, that is the product of one plus the toner concentration (TC) multiplied by the charge Q/M, for example 23 microcoulombs per gram.

$$A_t=(1+TC)Q/M$$

The fused images, that is personal checks with magnetic characters thereon, were of excellent quality, that is the check characters had high optical densities of greater than 1.3 (solid area image optical density) as measured on a Macbeth Densitometer and very low development of toner in background areas, that is minimum background deposits. Periodic visual microscopic inspection of the photoreceptor indicated no evidence of toner impacting onto the photoreceptor such as in small streaks of one millimeter or less, that is there was an absence of undesirable comets for 1.4 million copies. Examination of the Xerox Corporation 4135® test printer cleaning subsystem indicated a lack of excessive wear of components such as the detone blade.

When 500 checks prepared from the aforementioned developer were passed through an IBM 3890® Reader/Sorter, toner offsetting to the protective foils on the write and read heads were absent as evidenced by visual microscopic inspection, and there was no image smearing on the checks. These checks were repeatedly passed through the IBM 3890® for an additional 19 passes after which, upon inspection of the protective foil, there was evidence of only slight contamination.

EXAMPLE II

To 100 parts of the toner as prepared in Example I was added 1.0 percent (one part) of the aluminum oxide, Alumina C, as obtained from Degussa Corporation, 0.5 percent strontium titanate and 0.5 part or percent of KYNAR 201® in a Lodige blender. After blending the aforementioned components, 3.0 parts of the resulting toner formulation and 100 parts of the carrier particles of Example I were mixed on a paint shaker for 15 minutes. The toner had a triboelectric charge of a positive 20 μC/gram. After the addition of 1 additional part of the above prepared toner with the three surface additives to the developer of toner and carrier, and mixing the developer resulting for 15 seconds, the measured charge distribution evidenced a single narrow peak with an average Q/D of 0.55 fC/micron. The admix of the added toner was thus 15 seconds or less.

The above prepared developer was used in the Xerox Corporation 4135® test printer to generate 200,000 prints of excellent quality with no evidence of photoreceptor degradation by toner impaction. There was an absence of comets, as determined by microscopic examination, on the 200,000 MICR copies.

EXAMPLE III

There was prepared a toner by the process of Example I and wherein the toner contained 61.75 percent by weight of a polyester resin with an $M_w$ of 340,000 to 370,000, a Tg of 60° C. to 64° C., and with 4 to 8 percent gel as measured by collecting chloroform insolubles, and which resin was obtained from Kao Corporation of Japan as polyester resin NE 2010, a commercially available resin, and 29 percent by weight of an acicular magnetite MAGNOX B-353® obtained from Magnox Corporation, the highly crystalline polyethylene wax, POLYWAX 2000®, of density greater than 0.93 gram/cc in an amount of 5.25 percent by weight and which wax was obtained from Petrolite Corporation, 1.0 percent by weight of the charge control agent of the phosphomolybdate salt of rhodamine, that is FANAL PINK 4830® obtained from BASF, and 3 percent by weight of carbon black REGAL 330® obtained from Cabot Corporation. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles had an average volume size of 9 to 11 microns (average volume diameter). The toner obtained was blended with the same three surface additives of Example I, that is per 100 parts of toner, 1.0 part of HDK® 2050 silica, 1.0 part strontium titanate, and 0.5 part of KYNAR 201®. The resulting toner was used to prepare a developer containing 3 parts of toner and 100 parts of carrier, wherein the carrier was comprised of 65 microns nonround steel core, as obtained from Hoganaes Corporation, coated with 0.6 percent by weight of KYNAR 201® and PMMA (polymethylmethacrylate) in a ratio of 48 parts of KYNAR 201® and 52 parts of PMMA. The triboelectric charge of the toner after 15 minutes of agitating the developer was +17μC/gram. Subsequently, an additional 1 weight percent (one part) of uncharged toner with the same components in the same amounts was added to the above prepared developer of toner and carrier, and the added uncharged toner charged to 17 microcoulombs per gram within 15 seconds, that is the admix was 15 seconds.

The above prepared developer when used in a Xerox Corporation 4135® test printer provided prints of excellent quality, that is prints with excellent image density, low background, and no vinyl offset. Checks printed with the above toner were tested in an IBM 3890® Reader/Sorter and found to exhibit essentially no smear on the MICR character line after twenty passes through the Reader/Sorter. No comets were observed on the MICR checks.

COMPARATIVE EXAMPLE 1

There was prepared a toner of Example I in all respects except that no FANAL PINK® charge control agent was added. The triboelectric charge of the toner for a developer comprised of 3 parts of toner and 100 parts of the same carrier was (negative) −4μC/gram. When this toner was blended with 1 weight percent of Wacker HDK® 2050 EP silica in a Lodige blender and a developer prepared as illustrated in Example I, with the 48/52 KYNAR®/PMMA coated carrier, the toner charge after 15 minutes of paint shaking the developer was +23.7 μC/gram. In a test for admix with added uncharged toner, after adding 1 additional weight percent toner to the developer and shaking that developer for 15 and 30 seconds, (did not admix) two peaks were apparent, however, after 60 seconds there was a single broad peak indicating that the newly added toner did not charge up to the level of the incumbent toner, that is the admix was not acceptable and was about 2 minutes. The toner had a charge distribution of considerable wrong sign (negative charge) toner, that is 7.5 percent of the total number of particles measured. Thus, although a developer could be prepared with a positive charge, admix or rapid charging of newly added toner to the developer was slow and not acceptable. One consequence of this type of charging behavior was development of toner in the background area because of excessive wrong sign and low charge toner which resulted from slow admix.

COMPARATIVE EXAMPLE 2A

There was prepared a toner the same as that in Example I with 1 percent by weight of FANAL PINK® charge control agent. When this toner was blended with 1 weight percent of Wacker HDK® 2050 EP silica and no other surface additives in a Lodige blender, and a developer prepared with the 48/52 KYNAR®/PMMA coated carrier, the toner charge after 15 minutes of paint shaking the developer was +27.3 μC/gram. The average Q/D as measured in a charge spectrograph was 0.602 fC/micron. In a test for admix with added uncharged toner, after adding 1 additional weight percent toner to the developer and shaking that developer for 15 seconds, a single peak was apparent, indicating rapid admix.

The aforementioned developer was then used to develop latent images in a Xerox Corporation 4135® test printer. Although initial print quality was excellent, starting at 100,000 prints the quality degraded, image density decreased, and background on the prints increased. Measurement of the triboelectric charge on the toner indicated a drop to about 10 μC/gram. Also, impacted toner was observed on the photoreceptor after only 20,000 prints in the test fixture, which toner acted like a latent image and thereby printed out as spots or comets as determined with a microscope.

COMPARATIVE EXAMPLE 2B

There was prepared a toner the same as that in Example I with 1.0 percent by weight of FANAL PINK® charge control agent. This toner was blended with 1 weight percent of Wacker HDK® 2050 EP silica, and 1.0 percent by weight of strontium titanate in a Lodige blender and a developer was prepared by the process of Example I with the 48/52 KYNAR®/PMMA coated carrier particles. The toner charge after 15 minutes of paint shaking the developer was +24.0 μC/gram. The average Q/D as measured in a charge spectrograph was 0.595 fC/micron. In a test for admix with added uncharged fresh toner, after adding 1 additional weight percent of toner to the developer and shaking that developer for 15 seconds, a single peak was apparent, indicating rapid admix.

The aforementioned developer was then used to develop latent images as produced on the Xerox Corporation 4135® printer. Although initial print quality was excellent, beginning at 250,000 prints quality degraded for the same reason as noted in Example 2A. Impacted toner or comets, however, were observed on the photoreceptor starting at 200,000 prints. Also, excessive wear of photoreceptor cleaner subsystem parts, such as the toner detone blade, was observed by microscopic examination.

COMPARATIVE EXAMPLE 2C

There was prepared a toner the same as that in Example I with 1.0 percent by weight of FANAL PINK® charge control agent. This toner was then blended with 1 weight percent of Wacker HDK® 2050 EP silica and 2.0 percent by weight of strontium titanate in a Lodige blender. A developer prepared from the toner, and comprised of 3 parts of toner and 100 parts of the same carrier as that in Example 2B, exhibited a triboelectric charge of 22 μC/gram. This developer was used to develop latent images produced on the Xerox Corporation 4135®. The developer was used to produce 700,000 prints. The flexible photoreceptor remained free of comets throughout this test, however, the photoreceptor cleaning subsystem parts exhibited extensive abrasion.

COMPARATIVE EXAMPLE 3

There was prepared a toner by the same method as disclosed in Example I with the same formulation except that, rather than FANAL PINK®, a quaternary ammonium salt dimethyl distearyl ammonium sulfate (DDAMS) in an amount of 0.75 percent by weight was melt blended with the other components. This toner, when blended with 1.0 percent by weight with Wacker HDK® 2050 EP silica and formulated into a developer comprised of 3 parts of toner and 100 parts of carrier, the same as that used in previous Examples, exhibited a triboelectric charge as measured in a Faraday Cage apparatus of a positive charge 14.9 μC/gram. The average charge distribution, Q/D of toner in this developer, as measured on the Xerox Corporation charge spectrograph, was only 0.339. The average width of the distribution, as measured by the standard deviation of Q/D divided by Q/D, was 0.951, a broader charge spectrum. The developer had more than 30 number percent of toner particles with less than 0.2 fC/micron charge of which over 9 number percent was wrong sign toner.

Other modifications of the present invention may occur to those skilled in the art subsequent to a review of the present application, and these modifications, including equivalents thereof, are intended to be included within the scope of the present invention.

What is claimed is:

1. A toner consisting essentially of resin particles, magnetite pigment, carbon black pigment, rhodamine charge additive, wax, and a surface mixture of silica, strontium titanate and polyvinylidene fluoride; and wherein said resin particles are present in an amount of from about 50 to about 90 weight percent, said magnetite is present in an amount of from about 25 to about 40 percent, said carbon black is present in an amount of from about 1 to about 5 weight percent, said wax is present in an amount of from about 3 to about 15 weight percent, and said silica, strontium titanate and polyvinylidene fluoride are each present in an amount of from about 0.5 to about 2 weight percent.

2. A toner consisting essentially of resin particles, magnetite pigment, carbon black pigment, rhodamine charge additive, low molecular weight wax with a weight average molecular weight of from about 1,000 to about 20,000, and a surface mixture comprised of three components of silica, strontium titanate and polyvinylidene fluoride; and wherein each of said components is present in an amount of from about 0.5 to about 2 weight percent.

3. A toner consisting essentially of resin particles in an amount of from about 50 to about 90 weight percent; magnetite pigment in an amount of from about 25 to about 40 weight percent; carbon black pigment in an amount of from about 1 to about 5 weight percent; a nonpigment rhodamine charge additive in an amount of from about 0.5 to about 5 weight percent; low molecular weight wax with a weight average molecular weight of from about 1,000 to about 10,000, and present in an amount of from about 3 to about 10 weight percent; and a surface mixture of silica in an amount of from about 0.5 to about 2 weight percent, strontium titanate in an amount of from about 0.5 to about 2 weight percent and polyvinylidene fluoride in an amount of from about 0.5 to about 2 weight percent.

4. A toner in accordance with claim 3 wherein the resin particles are comprised of styrene butadiene present in an amount of from about 55 to about 70 weight percent; the magnetite is an acicular magnetite present in an amount of from about 27 to about 34 weight percent; the carbon black is present in an amount of from about 2 to about 3 weight percent; the rhodamine charge additive is present in an amount of from about 0.7 to about 1.5 weight percent; the low molecular weight wax has a weight average of from about 1,000 to about 3,000, and is present in an amount of from about 4.5 to about 6 weight percent; and the surface mixture is comprised of silica in an amount of from about 0.75 to about 1.0 weight percent, strontium titanate in an amount of from about 0.5 to about 1.25 weight percent and polyvinylidene fluoride in an amount of from about 0.5 to about 1.25 weight percent.

5. A toner in accordance with claim 1 wherein the wax has a weight average molecular weight of from about 1,000 to about 20,000.

6. A toner in accordance with claim 2 wherein the wax is crystalline polyethylene.

7. A toner in accordance with claim 2 wherein the silica is a fumed silica, or wherein said silica has been treated with an amino silane to enable it to charge positively against iron carrier particles.

8. A toner in accordance with claim 2 wherein the magnetite is acicular.

9. A toner in accordance with claim 4 wherein the styrene content of the polymer resin is at least 60 weight percent.

10. A toner in accordance with claim 4 wherein the styrene content of the polymer resin is from about 85 to about 95 weight percent.

11. A toner in accordance with claim 4 wherein the styrene butadiene contains about 89 to 91 percent by weight of styrene and about 11 to 9 weight percent of butadiene.

12. A toner in accordance with claim 2 with a positive triboelectric charge of from about 10 μC/grams to about 30 μC/grams.

13. A toner in accordance with claim 3 with a positive triboelectric charge of from about 15 μC/grams to about 25 μC/grams.

14. A toner in accordance with claim 1 wherein the resin particles are selected from the group consisting of styrene acrylates, styrene methacrylates, styrene butadiene, and polyesters.

15. A toner in accordance with claim 1 wherein the resin particles are comprised of a styrene butadiene copolymer.

16. A toner in accordance with claim 2 wherein the resin particles are comprised of a styrene butadiene copolymer.

17. A developer composition comprised of the toner of claim 1 and carrier particles.

18. A developer composition comprised of the toner of claim 2 and carrier particles.

19. A developer composition comprised of the toner of claim 3 and carrier particles.

20. A developer composition consisting essentially of carrier particles and a toner consisting essentially of resin particles in an amount of from about 50 to about 90 weight percent; magnetite pigment in an amount of from about 25 to about 40 weight percent; carbon black pigment in an amount of from about 1 to about 5 weight percent; nonpigment rhodamine charge additive in an amount of from about 0.5 to about 5 weight percent; low weight molecular weight wax of from about 1,000 to about 10,000 $M_w$ present in an amount of from about 3 to about 9 weight percent; and a surface mixture of silica in an amount of from about 0.7 to about 2 weight percent, strontium titanate in an amount of from about 0.5 to about 2 weight percent, and polyvinylidene fluoride in an amount of from about 0.5 to about 2 weight percent.

21. A developer composition comprised of carrier particles and a toner comprised of styrene butadiene resin particles in an amount of from about 55 to about 70 weight percent; acicular magnetite in an amount of from about 27 to about 32 weight percent; carbon black in an amount of from about 2 to about 3 weight percent; rhodamine charge additive in an amount of from about 0.7 to about 1.5 weight percent; low molecular weight wax with a weight percent average molecular weight of from about 1,000 to about 3,000 present in an amount of from about 4.5 to about 6 weight percent; and a surface mixture of silica in an amount of from about 1 weight percent, strontium titanate in an amount of from about 0.5 to about 1.25 weight percent, and polyvinylidene fluoride in an amount of from about 0.5 to about 1.25 weight percent.

22. A developer composition in accordance with claim 17 comprised of carrier particles and a toner comprised of polyester resin particles in an amount of from about 55 to about 70 weight percent; acicular magnetite in an amount of from about 27 to about 32 weight percent; carbon black in an amount of from about 2 to about 3 weight percent; rhodamine charge additive in an amount of from about 0.7 to about 1.5 weight percent; a low molecular weight wax, $M_w$ of from about 1,000 to about 3,000, present in an amount of from about 4.5 to about 6 weight percent; and a surface mixture of silica in an amount of from about 1 weight percent, strontium titanate in an amount of from about 0.5 to about 1.25 weight percent, and polyvinylidene fluoride in an amount of from about 0.5 to about 1.25 weight percent.

23. A developer in accordance with claim 17 wherein the carrier particles are comprised of a core with a polymer coating.

24. A developer in accordance with claim 17 wherein the carrier particles are comprised of a core with a first and second polymer coating, and wherein said coatings are not in close proximity in the triboelectric series.

25. A developer in accordance with claim 23 wherein the core is steel.

26. A developer in accordance with claim 24 wherein the first polymer is polyvinylidene fluoride and the second coating is polymethylmethacrylate.

27. A developer in accordance with claim 24 where said coatings on the carrier core are present in an amount of from about 0.2 weight percent to about 1.0 weight percent and preferably from about 0.4 weight percent to about 0.7 weight percent.

28. A developer in accordance with claim 26 wherein the ratio of polyvinylidene fluoride to polymethylmethacrylate is from 1 part polyvinylidene fluoride to 3 parts polymethylmethacrylate to 3 parts polyvinylidene fluoride to 2 parts polymethylmethacrylate.

29. A developer in accordance with claim 17 wherein the toner and carrier are in a proportion of from 2 parts toner to 100 parts carrier to 7 parts toner to 100 parts carrier.

30. A method of imaging which comprises formulating an electrostatic latent image on a photoreceptor, affecting development thereof with the toner composition of claim 1, and thereafter transferring the developed image to a suitable substrate.

31. A method of imaging which comprises formulating an electrostatic latent image on a photoreceptor, affecting development thereof with the toner composition of claim 2, and thereafter transferring the developed image to a suitable substrate.

32. A method of imaging which comprises formulating an electrostatic latent image on a photoreceptor, affecting development thereof with the toner composition of claim 3, and thereafter transferring the developed image to a suitable substrate.

33. A method of imaging which comprises formulating an electrostatic latent image on a photoreceptor, affecting development thereof with the toner composition of claim 4, and thereafter transferring the developed image to a suitable substrate.

34. A method of imaging which comprises formulating an electrostatic latent image on a photoreceptor, affecting development thereof with the developer composition of claim 17, and thereafter transferring the developed image to a suitable substrate.

35. A method in accordance with claim 31 wherein the developed image is free of comets.

36. A method in accordance with claim 32 wherein the developed image is free of comets.

37. A method in accordance with claim 33 wherein the developed image is free of comets.

38. A method in accordance with claim 34 wherein the developed image is free of comets.

39. A process for avoiding or minimizing comet formation in a magnetic image character recognition device which comprises utilizing for development a developer composition consisting essentially of carrier particles and a toner consisting essentially of resin particles in an amount of from about 65 to about 90 weight percent; magnetite in an amount of from about 25 to about 40 weight percent; carbon black in an amount of from about 1 to about 5 weight percent; rhodamine charge additive in an amount of from about 0.5 to about 5 weight percent; low molecular weight wax with a $M_w$ of from about 1,000 to about 10,000 in an amount of from about 3 to about 9 weight percent; and a surface mixture of silica in an amount of from about 0.7 to about 2 weight percent, strontium titanate in an amount of from about 0.5 to about 2 weight percent and polyvinylidene fluoride in an amount of from about 0.5 to about 2 weight percent.

40. A process for avoiding comet formation in a xerographic device that is used to prepare documents suitable for magnetic image character recognition systems which comprises utilizing a developer composition comprised of carrier particles and a toner comprised of styrene butadiene, or polyester resin particles; acicular magnetite in an amount of from about 27 to about 32 weight percent; carbon black in an amount of from about 2 to about 3 weight percent; rhodamine charge additive in an amount of from about 0.7 to about 1.5 weight percent; low molecular weight wax, from about 1,000 to about 3,000, in an amount of from about 4.5 to about 6 weight percent; and a surface mixture of silica in an amount of from about 1 weight percent, strontium titanate in an amount of from about 0.5 to about 1.25 weight percent and polyvinylidene fluoride in an amount of from about 0.5 to about 1.25 weight percent.

41. A toner in accordance with claim 3 wherein the resin particles are comprised of a polyester.

42. A toner in accordance with claim 3 wherein the wax is a highly crystalline polyethylene with a density of equal to or greater than about 0.93 gram/cc.

43. A toner in accordance with claim 42 wherein the molecular weight of the highly crystalline wax is from about 1,000 to about 5,000.

44. A toner in accordance with claim 3 wherein the rhodamine salt is of the following formula

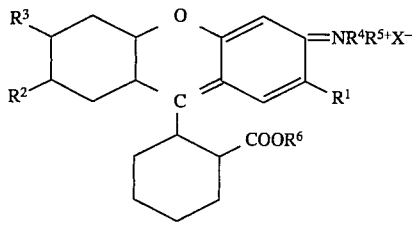

wherein:

$R^1$=H, or —$CH_3$ $R^2$=H, or —$CH_3$ $R^3$=—$NH(C_2H_5)$, or —$N(C_2H_5)_2$ $R^4$=H, or —$C_2H_5$ $R^5$=—$C_2H_5$, —$C_6H_5$, —$C_6H_4SO_3$—, —$C_6H_3$—, or 2,6-$(CH_3)_2$ $R^6$=H, or $C_2H_5$

X=silicomolybdate, phosphomolybdate, phosphotungstmolybdate, or the anion of copper ferrocyanic acid.

45. A toner in accordance with claim 44 wherein X is silicomolybdate.

46. A toner in accordance with claim 1 wherein the remanence of said toner as measured on a magnetometer at 1,000 Oersteds is about 8.5 to about 11 emu/gram.

47. A toner in accordance with claim 41 wherein the polyester has a weight average molecular weight of from about 340,000 to about 370,000, a molecular weight distribution $M_w/M_n$ of from 40 to 90, and a glass transition temperature of from about 55° C. to about 65° C.

48. A toner in accordance with claim 3 wherein the wax is present in an amount of from about 4.5 to about 6 weight percent; and there is present a surface mixture of silica in an amount of from about 1 weight percent, strontium titanate in an amount of from about 0.5 to about 1.25 weight percent, and polyvinylidene fluoride in an amount of from about 0.5 to about 1.25 weight percent.

49. A toner in accordance with claim 3 wherein there is selected 27 to 32 percent of acicular magnetite; 0.7 to 1.5 percent of the charge additive FANAL PINK 4830®; 4.5 to 6 percent of the crystalline polyethylene wax POLYWAX 2000® with a $M_w$ of from about 1,000 to about 3,000; 1 to 5 weight percent of REGAL 330® carbon black; the resin particles are comprised of styrene butadiene copolymer resin (PLIOTONE®); and three surface additives of 1 percent of treated silica; 0.5 to 1.25 percent of strontium titanate; and 0.5 to 1.5 percent of polyvinylidene fluoride.

50. A toner in accordance with claim 7 wherein the silica exhibits a BET surface area of about 150 $m^2$/gram, and said silica has been treated with a coating of N-2-aminoethyl-3-aminopropyl trimethyl silane and dimethyldichlorosilane.

51. A process for generating documents which comprises providing the document desired, imprinting characters thereon with a high speed electronic printing device, and developing the characters with a toner consisting essentially of resin particles, magnetite, carbon black, rhodamine charge additive, low molecular weight wax with a weight average molecular weight of from about 1,000 to about 20,000, and a surface mixture comprised of three components of silica, strontium titanate and polyvinylidene fluoride; or a toner comprised of resin particles in an amount of from about 50 to about 90 weight percent; magnetite in an amount of from about 25 to about 40 weight percent; carbon black in an amount of from about 1 to about 5 weight percent; rhodamine charge additive in an amount of from about 0.5 to about 5 weight percent; low molecular weight wax with a weight average molecular weight of from about 1,000 to about 10,000, and present in an amount of from about 3 to about 10 weight percent; and a surface mixture of silica in an amount of from about 0.5 to about 2 weight percent, strontium titanate in an amount of from about 0.5 to about 2 weight percent, and polyvinylidene fluoride in an amount of from about 0.5 to about 2 weight percent.

52. A process in accordance with claim 51 wherein the documents are personal checks, the magnetite is an acicular magnetite, and the characters are generated by electrostatographic methods.

53. A toner consisting of resin particles, magnetite pigment, carbon black pigment, nonpigment rhodamine charge additive, wax, and a surface mixture of silica, strontium titanate and polyvinylidene fluoride; and wherein said resin particles are present in an amount of from about 50 to about 90 weight percent, said magnetite is present in an amount of from about 25 to about 40 percent, said carbon black is present in an amount of from about 1 to about 5 weight percent, said wax is present in an amount of from about 3 to about 15 weight percent, and said silica, strontium titanate and polyvinylidene fluoride are each present in an amount of from about 0.5 to about 2 weight percent.

* * * * *